US007438522B2

(12) United States Patent
Eimer

(10) Patent No.: US 7,438,522 B2
(45) Date of Patent: Oct. 21, 2008

(54) FAN

(75) Inventor: Georg Eimer, St. Georgen (DE)

(73) Assignee: EBM-Papst St. Georgen GmbH & Co. KG, St. Georgen (DE)

( * ) Notice: Subject to any disclaimer, the term of this patent is extended or adjusted under 35 U.S.C. 154(b) by 103 days.

(21) Appl. No.: 10/553,496

(22) PCT Filed: Apr. 14, 2004

(86) PCT No.: PCT/EP2004/003916

§ 371 (c)(1),
(2), (4) Date: Oct. 13, 2005

(87) PCT Pub. No.: WO2004/094835

PCT Pub. Date: Nov. 4, 2004

(65) Prior Publication Data

US 2006/0210397 A1 Sep. 21, 2006

(30) Foreign Application Priority Data

Apr. 19, 2003 (DE) ..... 203 06 455 U

(51) Int. Cl.
*F04D 29/38* (2006.01)

(52) U.S. Cl. ..... 415/173.6; 415/211.2; 416/228; 416/189; 416/238; 416/243

(58) Field of Classification Search ..... 416/228, 416/235, 236 R, 238, 243, 189; 415/211.2, 415/173.6
See application file for complete search history.

(56) References Cited

U.S. PATENT DOCUMENTS 1,518,501 A * 12/1924 Gill ..... 416/189
5,181,830 A * 1/1993 Chou ..... 416/223 R
5,297,931 A 3/1994 Yapp et al. ..... 415/208.1

(Continued)

FOREIGN PATENT DOCUMENTS

DE 2 017 226 A 10/1971

(Continued)

*Primary Examiner*—Ninh H Nguyen
(74) *Attorney, Agent, or Firm*—Milton Oliver, Esq.; Ware Fressola Van Der Sluys & Adolphson LLP

(57) ABSTRACT

A fan has an air conveying conduit (16) and a fan wheel (22) arranged therein, which wheel is rotatable about a central axis (25) and is formed with a central hub (20; 120) having an outer periphery (27) on which fan blades (26) are mounted. These extend with their radially outer rims (40) as far as a surface (17) that is substantially coaxial with the central axis (25) and delimits the air conveying conduit (16) externally. The blades (26) have a profile similar to an airfoil profile. A flow element (42) is provided along the radial outer edge (40) of a fan blade and serves as an obstacle to a compensating flow proceeding around that radial outer edge (40) from the delivery side to the intake side, and likewise has, in cross section, an airfoil profile.

Adjacent the front edge (28) and rear edge (36) of a blade (26), it has substantially the same outline as the adjacent part of the associated blade (26), and in a middle region (48) between the front and back edge is wider, by an approximately constant amount, than the adjacent part of the blade (26).

54 Claims, 12 Drawing Sheets

U.S. PATENT DOCUMENTS

| | | | | |
|---|---|---|---|---|
| 5,393,199 | A | 2/1995 | Alizadeh | 416/189 |
| 5,695,318 | A | 12/1997 | Harmsen | 415/218.1 |
| 5,769,607 | A | 6/1998 | Neely | 416/189 |
| 6,481,963 | B1 | 11/2002 | Lin | 415/220 |
| 6,517,315 | B2 * | 2/2003 | Belady | 415/221 |
| 6,595,744 | B2 * | 7/2003 | Van Houten | 415/173.1 |
| 6,626,640 | B2 * | 9/2003 | Ivanovic | 415/142 |
| 2002/0182071 | A1 | 12/2002 | Belady | 415/220 |
| 2003/0012653 | A1 | 1/2003 | Diemunsch | 416/193 R |
| 2003/0123988 | A1 | 7/2003 | Wen | 416/228 |

FOREIGN PATENT DOCUMENTS

| | | |
|---|---|---|
| DE | 30 17 226 | 11/1980 |
| DE | 30 17 943 | 11/1980 |
| DE | 31 37 114 | 4/1982 |
| DE | 41 27 134 | 2/1993 |
| DE | 41 40 987 | 6/1993 |
| DE | 199 48 074 | 4/2000 |
| DE | 200 14 150 U | 11/2000 |
| DE | 102 20 398 | 2/2003 |
| EP | 0 583 091 | 7/1997 |
| GB | 2 050 530 A | 1/1981 |

* cited by examiner

FAN

CROSS REFERENCE

This application is a section 371 of PCT/EP 2004/003916, filed 14 Apr. 2004, published 4 Nov. 2004 as WO 2004/094835-A1.

FIELD OF THE INVENTION

The present invention relates to a fan having an air conveying conduit and having a fan wheel arranged rotatably therein, the blades of which wheel are equipped, in the region of their external edges, with flow elements that have low resistance to the conveyed flow and that constitute an obstacle to the compensating flows proceeding around the outer edges of the blades from the delivery side to the intake side.

BACKGROUND

A fan having such flow elements is known from the commonly assigned DE 30 17 226 A and corresponding GB 2 050 530-A, HARMSEN. This These unexamined applications describes a variety of designs for such flow elements, in combination with fan blades stamped out of sheet metal. These flow elements reduce the leakage flow in a fan equipped therewith.

SUMMARY OF THE INVENTION

It is an object of the invention to provide a new fan that exhibits a reduced noise level, at least in a predetermined operating range.

According to a first aspect of the invention, this object is achieved by a fan in which the fan blades are sickle-shaped and are provided, adjacent their tips, with flow-pattern obstacles which minimize air leakage between the intake side of the fan and the delivery side of the fan. It has been shown that, surprisingly, in such a fan the fan noise decreases, in particular, in the so-called laminar region, i.e. with high conveying volumes and a relatively small pressure rise Δp. A noise reduction occurs with such a fan in the non-laminar region as well, i.e. with higher back pressures and smaller air quantities. A theoretical explanation might be that an air flow occurs along the sickle-shaped front edges of the fan blades, and this air flow flows practically as far as the outer periphery of the hub, where the circumferential velocity is lowest, and consequently little noise is generated by this flow. The degree of sickling is, of course, limited by the fact that with a very pronounced sickle shape, the axial length of such a fan might become too great.

The stated object is achieved in another way by providing ends of the fan blades with flow elements which themselves are airfoil-shaped and which, in a middle region between their front and back edges, are wider than an adjacent part of the fan blade. It has been shown that this type of configuration of the profile of the blade and flow element contributes to particularly quiet running of the fan.

BRIEF FIGURE DESCRIPTION

Further details and advantageous refinements of the invention are evident from the exemplifying embodiments, in no way to be understood as a limitation of the invention, that are described below and depicted in the drawings.

Figure 3:
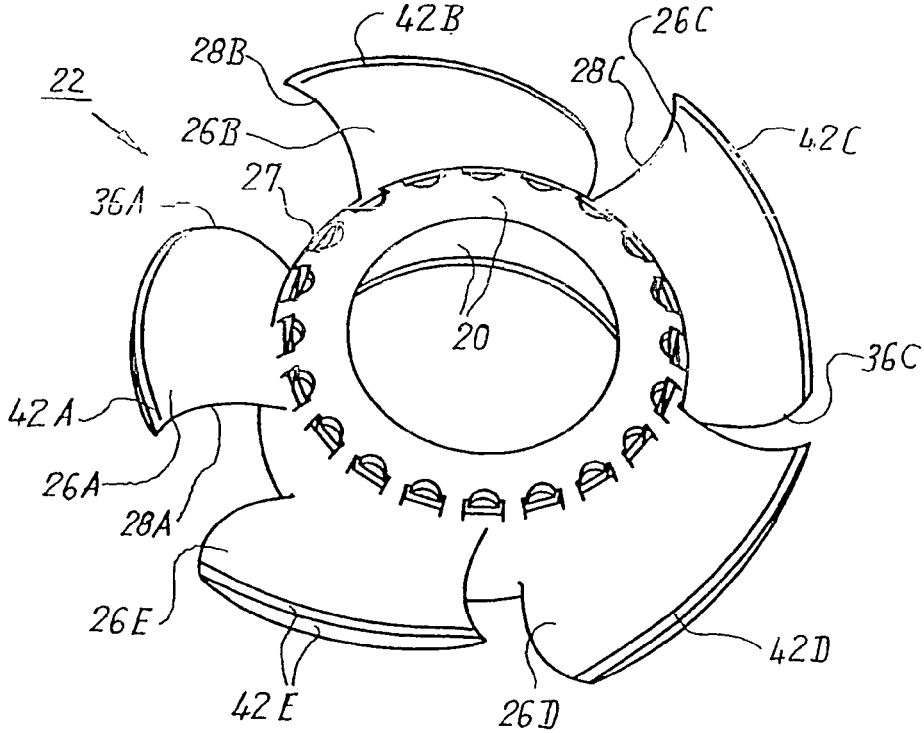
FIG. 3 is a three-dimensional depiction of the fan wheel according to FIGS. 1 and 2.
Figure 13:
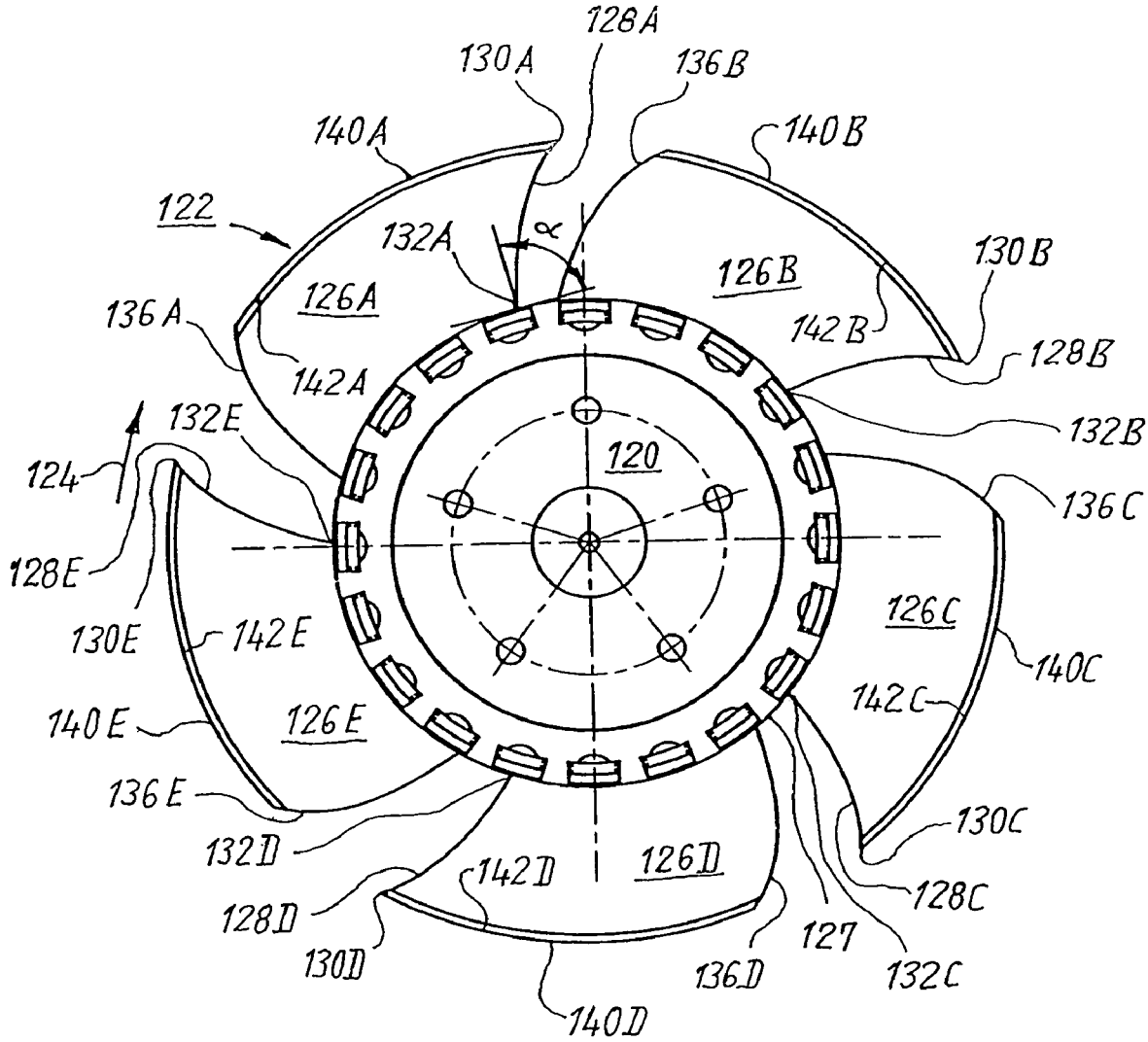
FIG. 13 is a plan view, analogous to FIG. 2, of a fan wheel 122 according to a second embodiment of the invention.
Figure 14:
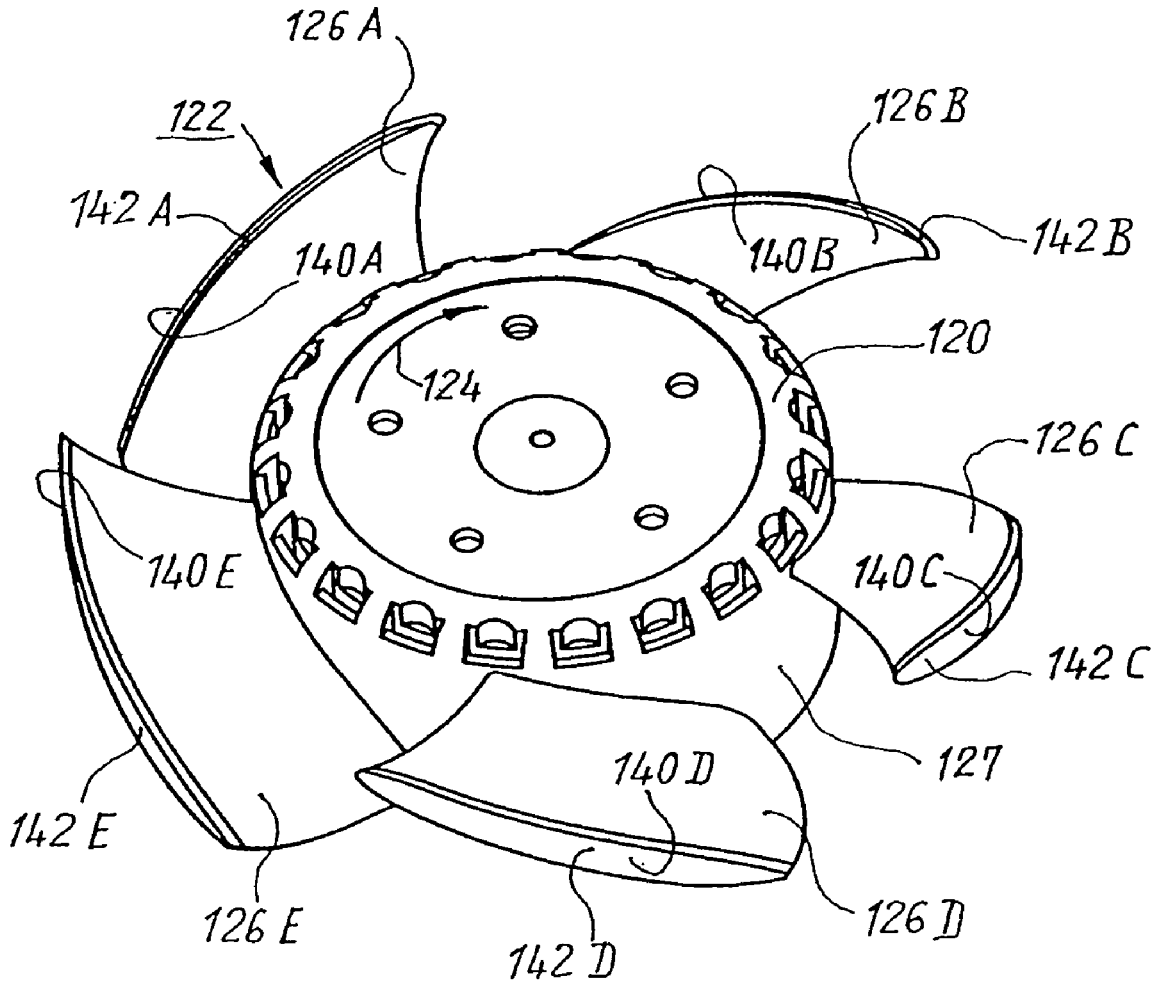
Figure 15:
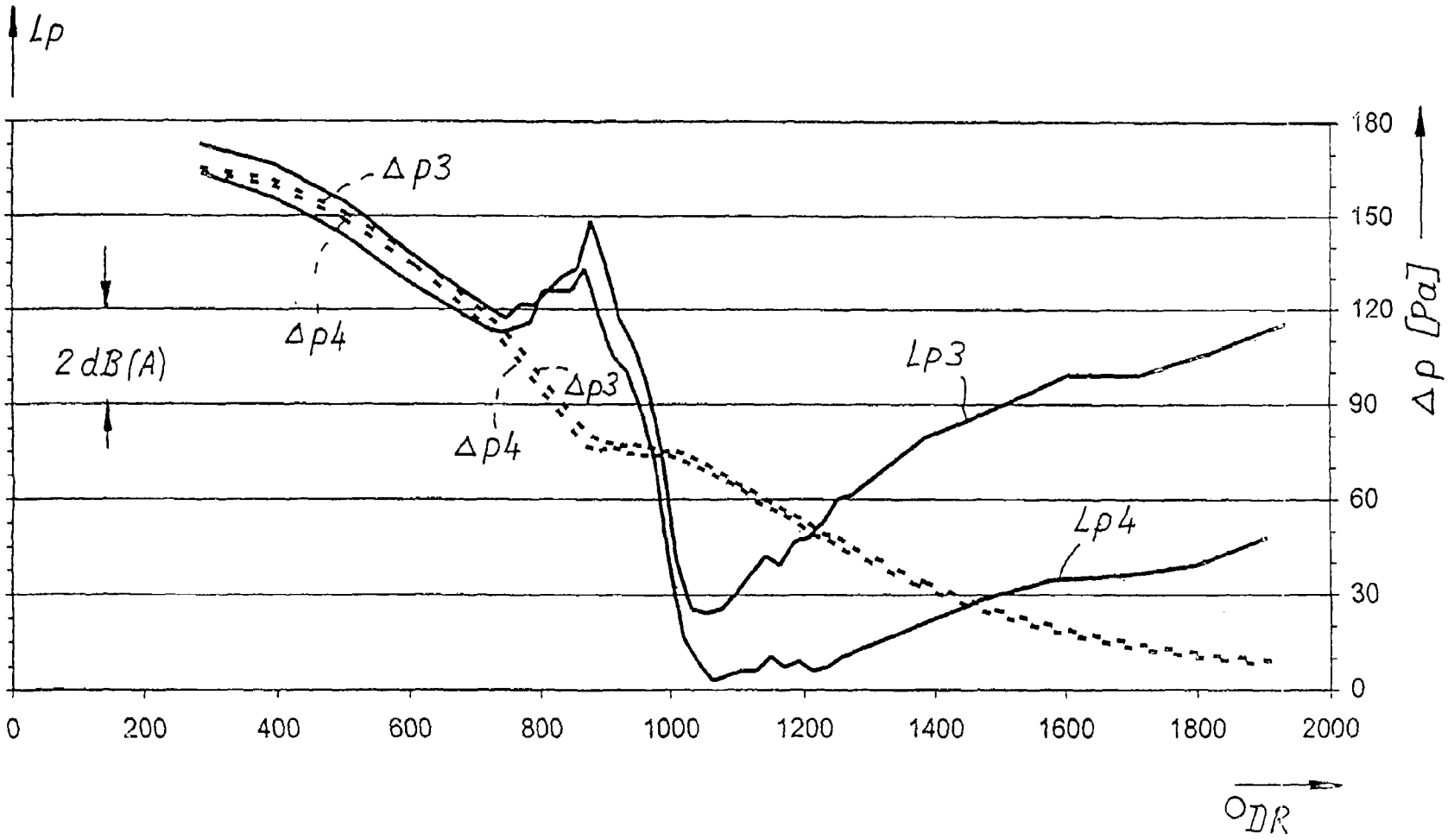

FIG. 14 is a three-dimensional depiction of fan wheel 122 of FIG. 13 in a depiction analogous to FIG. 3; and FIG. 15 is a comparative depiction showing fan characteristic curves for fan wheel 122 according to FIGS. 13 and 14, with and without the special flow elements (winglets).

DETAILED DESCRIPTION

In the figures that follow, the same reference characters are used in each case for identical or identically functioning components, incremented by 100 if applicable (e.g. 122 instead of 22), and these components are usually described only once.

Figure 1:
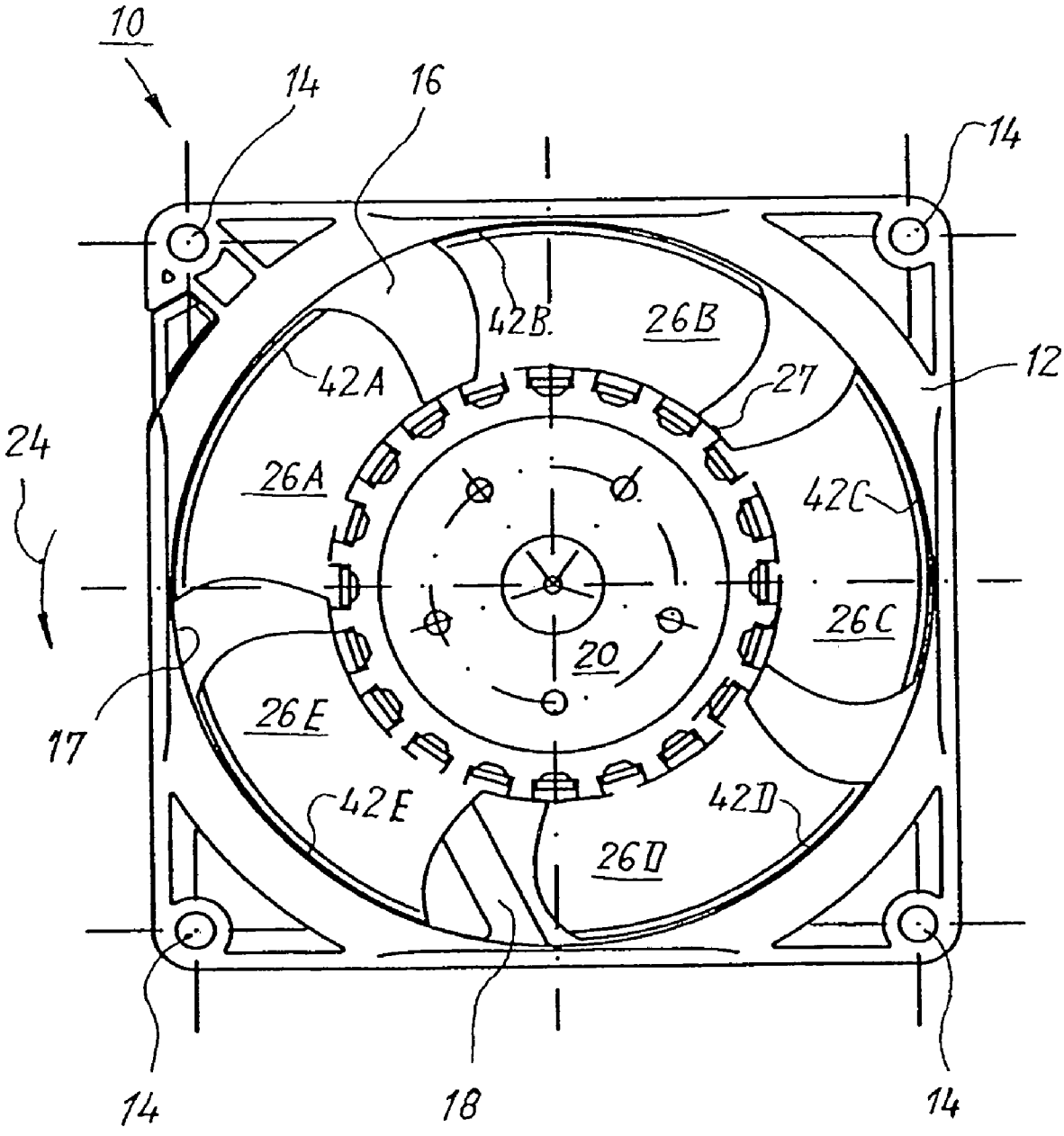
FIG. 1 is a plan view of an equipment fan, in this case an axial fan, according to a first exemplifying embodiment of the invention.

FIG. 1 shows an equipment fan 10 of ordinary design. The present invention can be realized implemented in an axial fan and, alternatively, in a diagonal fan. Fan 10, depicted in FIG. 1, has an external housing 12, at the four corners of which respective mounting openings 14 are provided and which defines in its interior an air conveying conduit 16, which conduit is limited toward the outside by a rotation surface 17 and in which conduit is rotatably mounted, via struts 18, the central hub 20 of a fan wheel 22 that, in operation, is rotated about a central axis 25 (FIGS. 4 and 5) by an electric motor arranged inside this hub 20. In FIG. 1, hub 20 rotates counterclockwise in the direction of an arrow 24. The air flow is such that the air is blown out over struts 18, i.e. through the back or "delivery" side of fan 10 with reference to FIG. 1.

As FIGS. 1 to 5 show, five fan blades 26, labeled 26A to 26E, are mounted on outer periphery 27 of hub 20. In this exemplifying embodiment, the angular distance beta (FIG. 2) from front edge 28A of fan blade 26A to front edge 28B of blade 26B is 74°. Blades 26 are distributed irregularly over the periphery of the hub in order to obtain a more pleasant frequency spectrum. The type of distribution depicted represents, of course, only a preferred embodiment.

Figure 2:
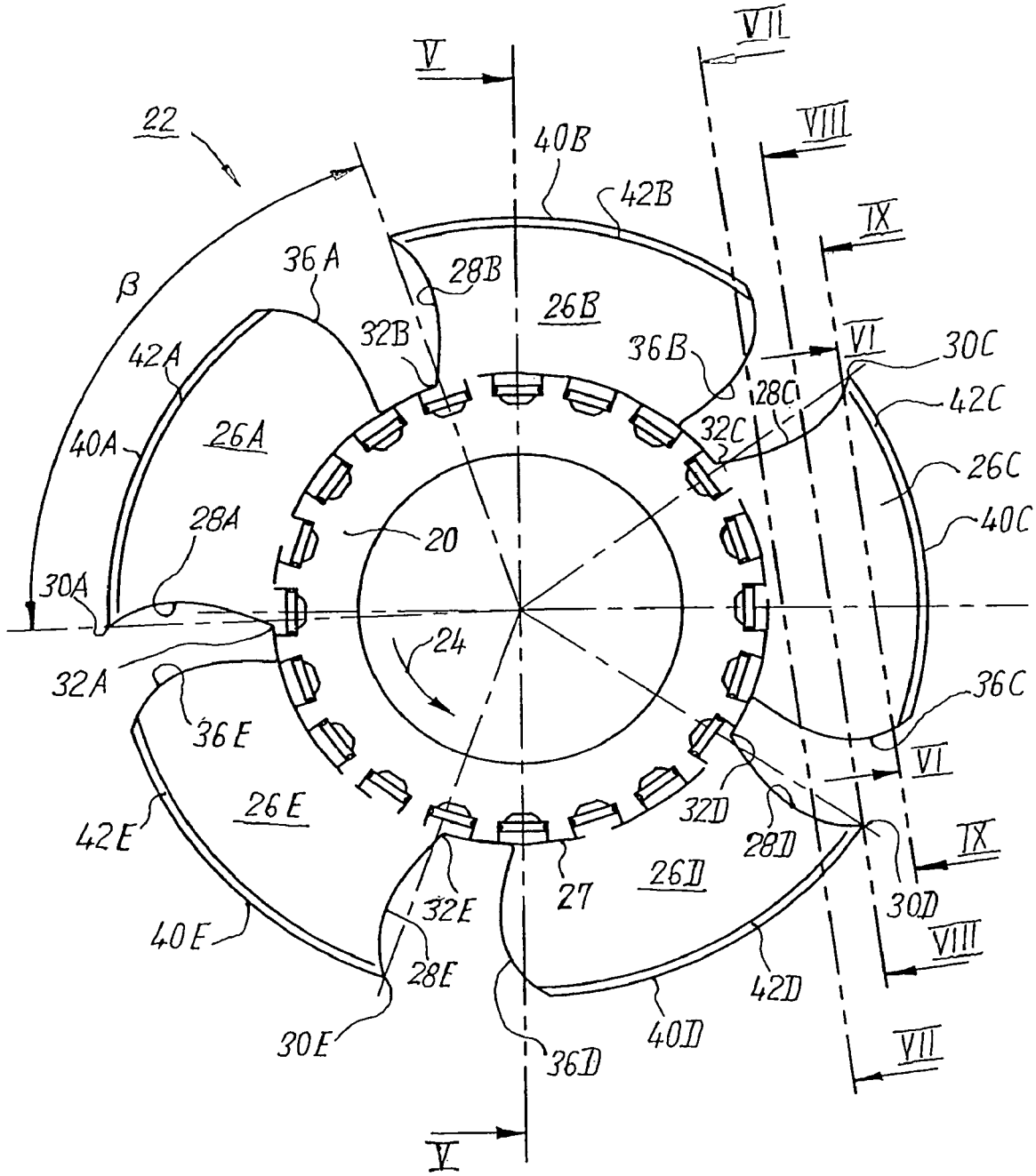
FIG. 2 depicts the fan wheel of the fan of FIG. 1 in an enlarged depiction.

As FIGS. 1 to 3 show, front edges 28A to 28E of blades 26 are embodied in concave and sickle-shaped fashion. The rear edges of blades 26 are labeled 36A to 36E, and are convex. They are implemented in such a way that their intersection with struts 18 occurs in "grazing" fashion, i.e. "with a grazing intersection." This means that, in most or all rotational positions and when viewed in plan, the imaginary intersection between a strut 18 and a rear edge 36 (which of course do not touch another) occurs at an angle as clearly shown, for example, in FIG. 1. This feature contributes to noise damping.

Figure 5:
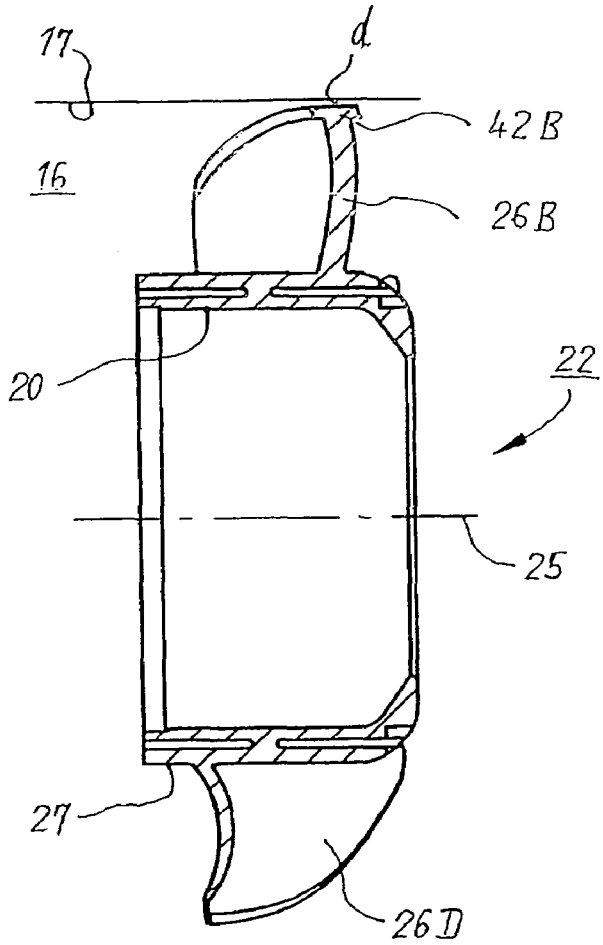
FIG. 5 is a section viewed along line V-V of FIG. 2.

The radially outer edges of blades 26 are labeled 40A to 40E. As depicted in FIG. 5, these edges 40 are at a radial distance d from inner side 17 of external housing 12. This "air gap" d should be as small as possible. If it is large, a considerable leakage flow flows through it from the delivery side to the intake side of fan 10.

To reduce this air flow, the individual blades 26 are equipped in the region of their radially outer edges 40 with flow elements 42A to 42E, specifically with enlargements of outer blade edges 40, which enlargements preferably extend in the axial direction toward the intake side and the delivery side. (With diagonal fans, it is preferable to use blades on which such flow elements are present only on the intake side.) As is evident from the sagittal sections of FIGS. 6 to 9, blades 26 have approximately the cross-sectional shape of an aircraft airfoil, i.e. front edge 28C is round and relatively blunt. From there, the thickness D (FIG. 6) of a blade 26 first increases and then decreases again toward rear edge 36, and blade 26 tapers to a sharp rear edge 36, in order to reduce or prevent the creation of eddies there, and consequently the creation of noise.

Figure 6:
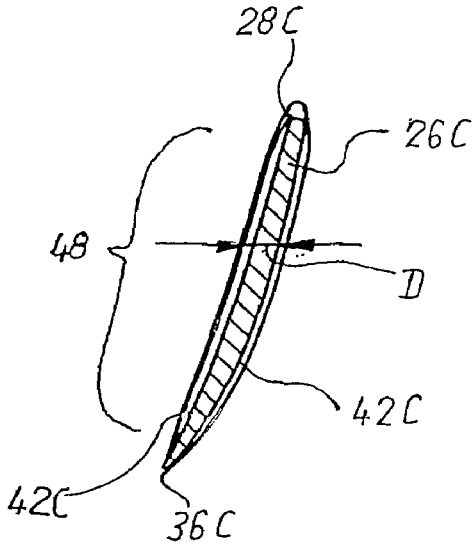
FIG. 6 is a sagittal section through a blade of the fan of FIGS. 1 to 5, viewed along line VI-VI of FIG. 2.
Figure 7:
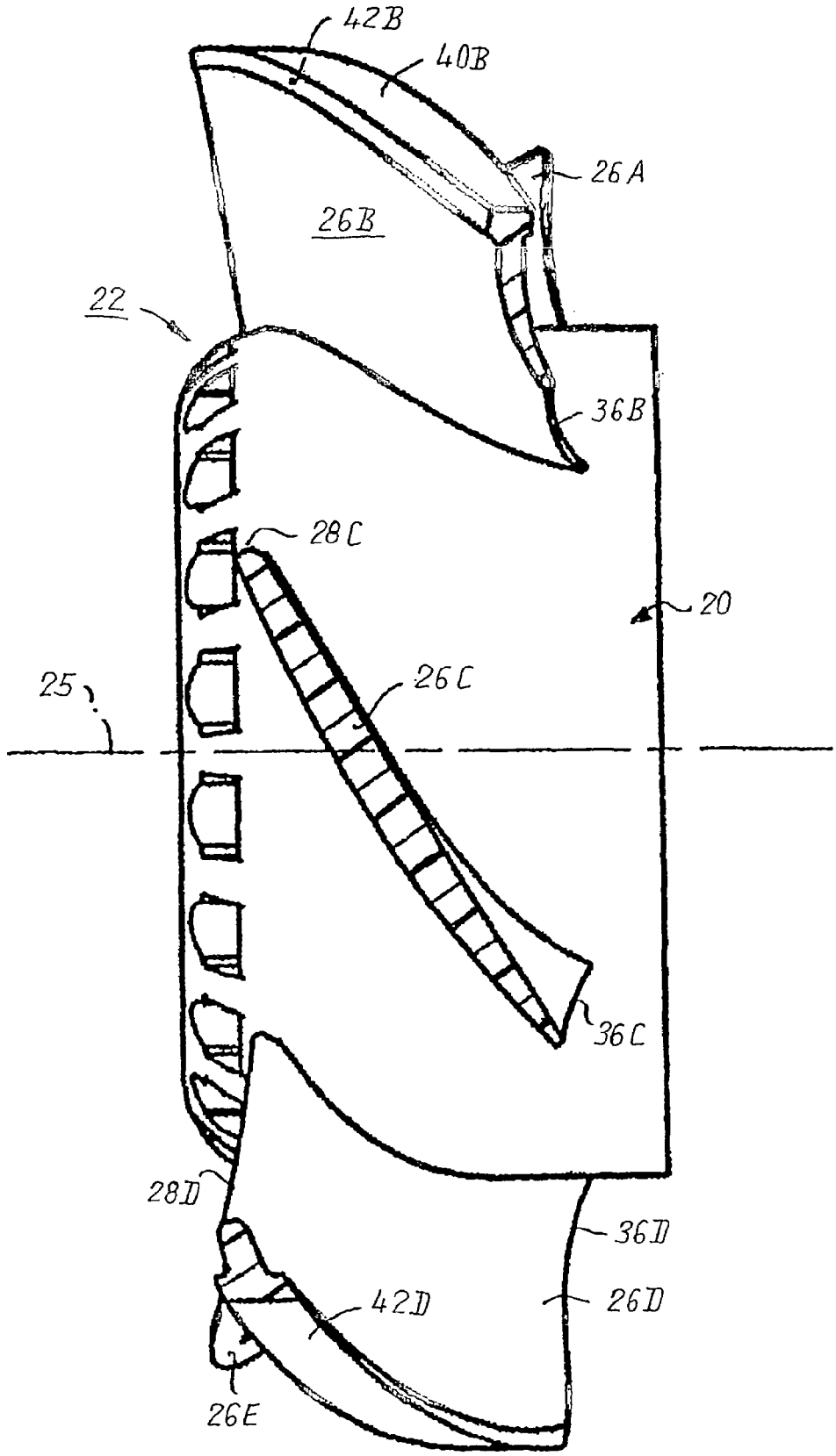
FIG. 7 is a section viewed along line VII-VII of FIG. 2, in an enlarged depiction.
Figure 8:
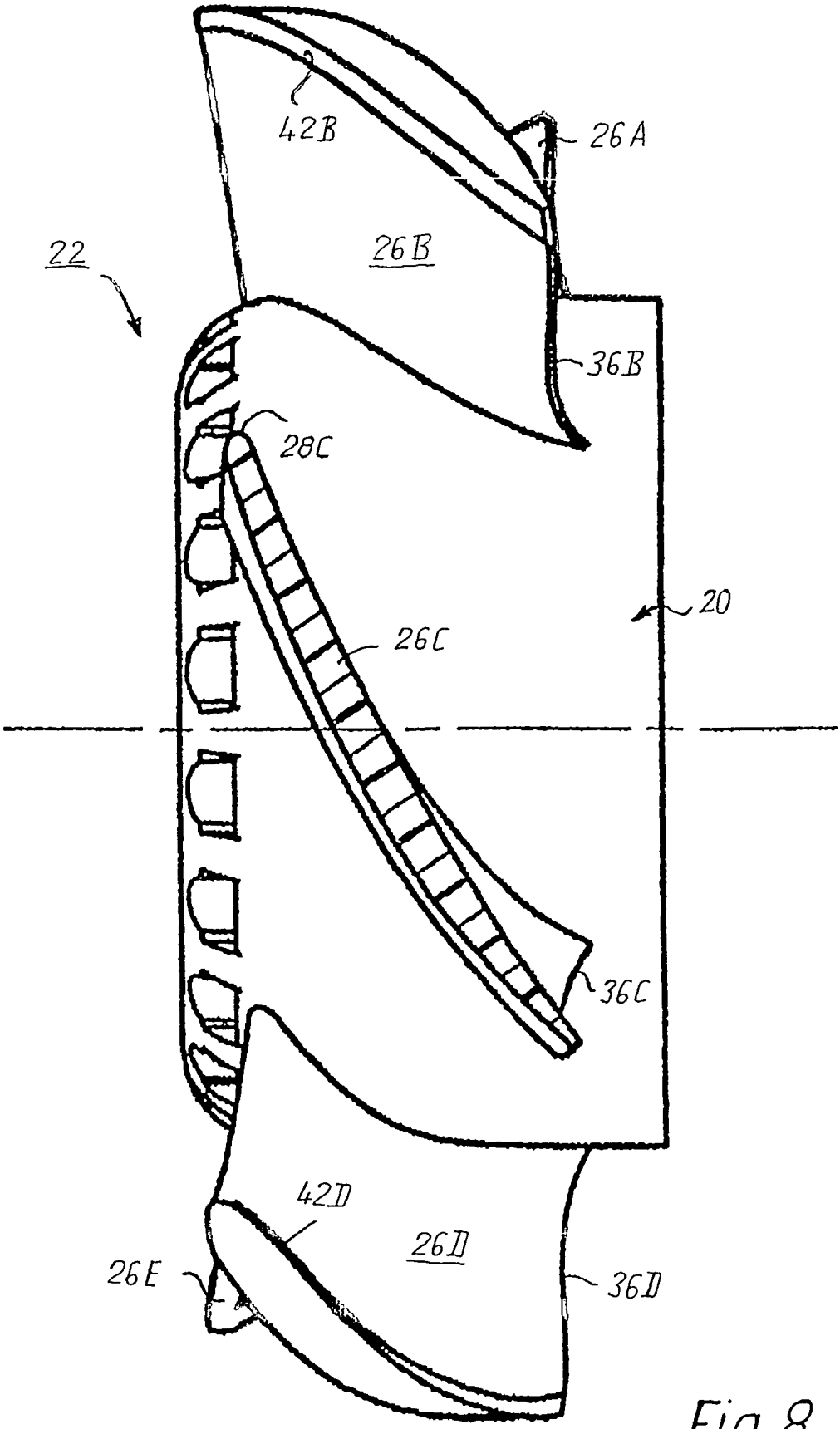
FIG. 8 is a section analogous to FIG. 7, viewed along line VIII-VIII of FIG. 2.
Figure 9:
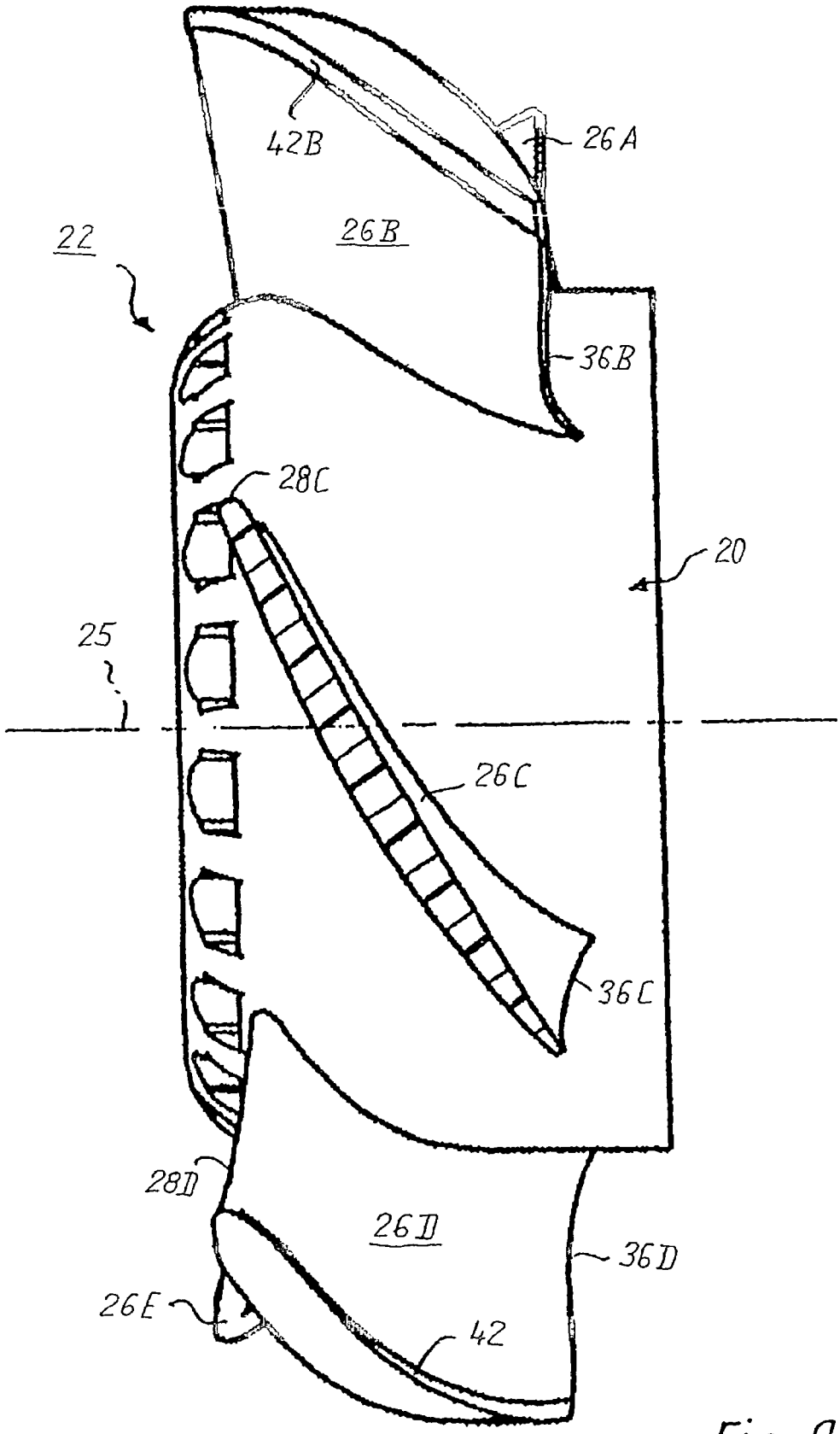
FIG. 9 is a section analogous to FIG. 7, viewed along line IX-IX of FIG. 2.

Flow elements 42 have an outline analogous to that of the associated blades (cf. FIG. 6), i.e. they likewise taper to a sharp rear edge 36 and are rounded at front edge 28; and in intermediate region 48 between the region of front edge 28 and the region of rear edge 36, they protrude beyond blade 26 by a substantially constant amount in the axial direction, as clearly shown by FIGS. 5 and 6. A smooth transition is provided at both ends, i.e. the constant amount smoothly decreases there to zero.

Flow elements 42, in combination with the narrow air gap d (FIG. 5), present an elevated resistance to the leakage flow that proceeds, during operation, around outer rim 40 of blades 26 from the delivery side to the intake side.

Figure 4:
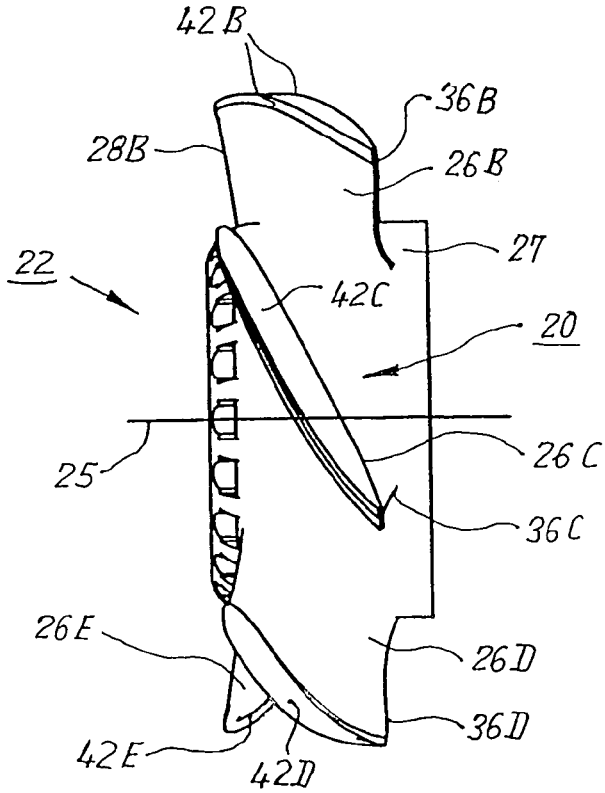
FIG. 4 is a side view of the fan wheel of FIGS. 1 to 3.

As is apparent in particular from FIGS. 3 and 4, the individual blades 26 are twisted, i.e. the location from which a blade 26, so to speak, "grows" out of hub 20 has approximately the shape of a screw-thread segment, and outer edges 40 of blades are likewise shaped in the manner of a screw-thread segment, although, as depicted shown, the pitch of the screw-thread segments is greater in the region of hub 20 than in the region of the radially outer edges 40.

Figure 10:
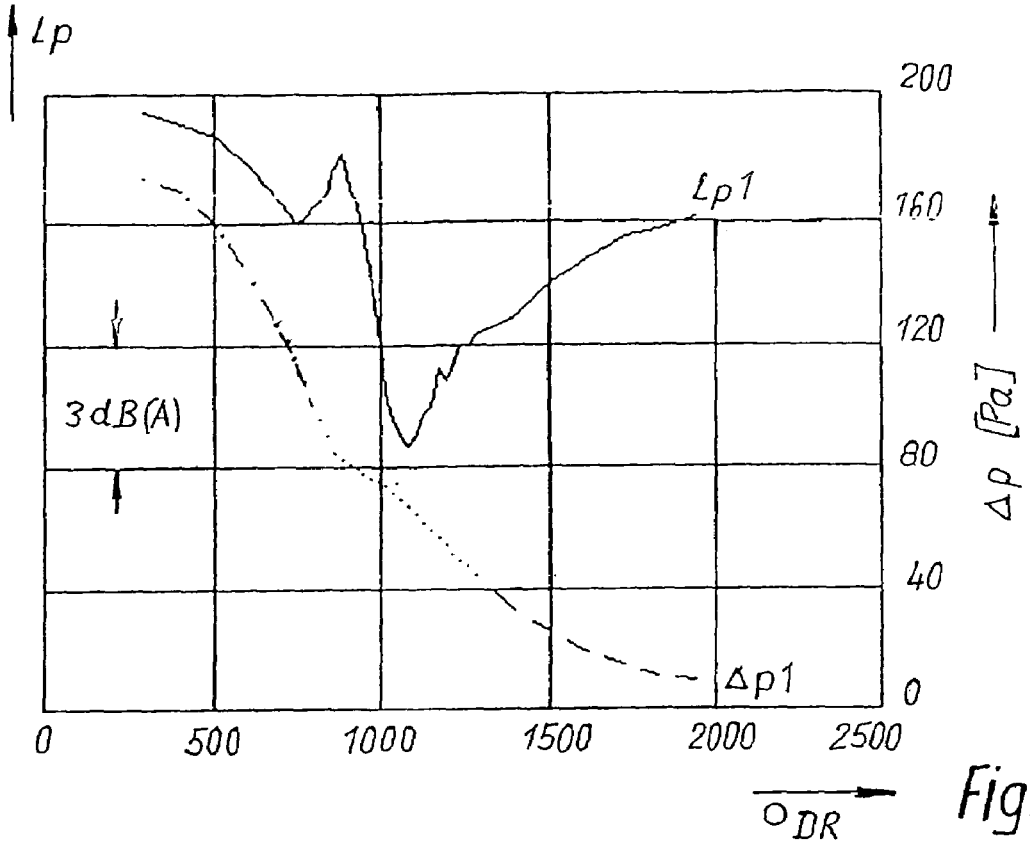
FIG. 10 is a depiction of the acoustic pressure level Lp and pressure increase Δp plotted against the slider position of a test stand, for an axial fan whose fan blades have no flow elements on the outer edge.

FIG. 10 shows the pressure rise Δp1 and acoustic pressure level Lp1 for a fan whose blades 26 are not equipped with flow elements 42. The curves were measured on an ordinary fan test stand in which an adjustable throttle (not shown) is arranged on the delivery side of fan 10. The opening ODR of this throttle is indicated on the horizontal axis with values between 0 and 2500, "0" meaning that the throttle is closed.

It is apparent that for a throttle opening below 1000, fan 10 is working in the turbulent flow region, with the pressure Δp1 and acoustic pressure level Lp1 rising toward the left.

For values to the right of the value of 1000 for the throttle opening, i.e. as the throttle is opened further, the pressure Δp1 decreases and the volume of air conveyed rises correspondingly, this being associated with a higher Lp1.

Figure 11:
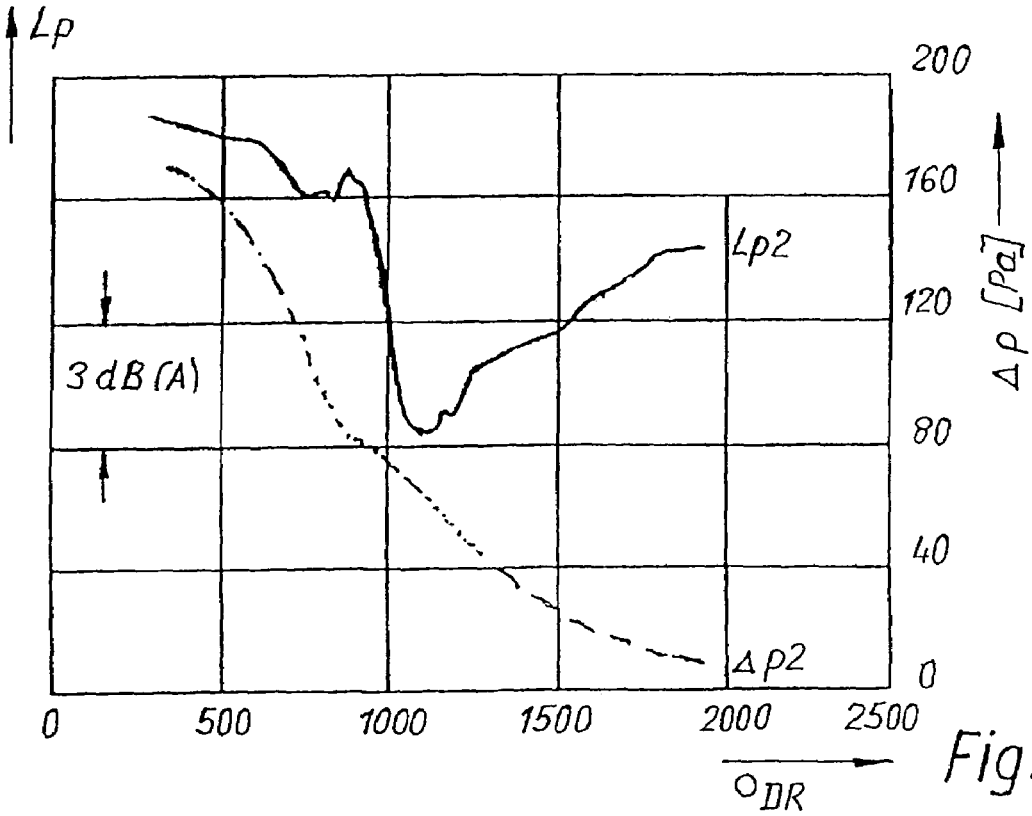
FIG. 11 is a depiction analogous to FIG. 10, for a fan of the same construction but in which the fan blades are equipped on their outer edge with special flow elements.

FIG. 11 shows curves for the exemplifying embodiment described here, i.e. the fan is the same as in FIG. 10 but fan wheel 22 is equipped with the above-described flow elements 42.

The profile of the pressure curve (Δp2) is the same as in FIG. 10, but the acoustic pressure level Lp2 is reduced by approximately 1.5 to 2 dB(A), especially in the region of larger throttle openings (approximately 1100 and up).

Curves Lp1 and Lp2 are largely coincident in the region around a throttle opening of 1000, but a drop in the acoustic pressure level is once again observable in the region below a throttle opening of 600.

The above-described flow elements 42 thus yield, without any additional effort, a reduction in acoustic pressure level Lp which is acoustically perceptible and whose magnitude depends on the working point at which the relevant fan 10 is operated. The sickling of front edges 28 likewise contributes to a diminution in noise.

FIGS. 13 and 14 show a fan wheel 122 according to a second, particularly preferred exemplifying embodiment of the invention, having a central hub 120. The external housing of this fan wheel has the same shape as external housing 12 of FIG. 1, and is therefore not depicted again. The rotation direction is labeled 124, i.e. fan wheel 122 rotates clockwise. FIG. 14 is a view toward the intake side of fan wheel 122.

As FIGS. 13 and 14 show, five fan blades 126 labeled 126A to 126E are mounted on outer periphery 127 of hub 120. Just as in the first exemplifying embodiment, these blades are distributed unevenly around periphery 127 of hub 120 in order to obtain a pleasant frequency spectrum for the fan noise.

As FIGS. 13 and 14 show, front edges 128A to 128E of blades 126 are concave and strongly sickle-shaped in configuration. In this exemplifying embodiment outer end 130A to 130E of sickles 128 is preferably located, when viewed in rotation direction 124, in front of transition point 132A to 132E of sickles 128 into hub 120; in particularly preferred fashion these transition points 132A to 132E are located all the way at the back with reference to rotation direction 124, i.e. the entire sickle 128 extends, as depicted, from this transition point 132 forward in the rotation direction. This results, for example at transition point 132A, in a value of approximately 78° for the angle alpha at which sickle edge 128A emerges from hub 120. This angle alpha is, for example, greater than 90° in FIGS. 1 to 12,. It should preferably be less than 90° and has preferred values between 70 and 90°, in particular between 75 and 85°.

As explained below with reference to measurement curves, this configuration yields a considerable additional noise reduction, but usually requires a larger axial extension of the fan than with the version according to FIGS. 1 to 12.

Figure 12:
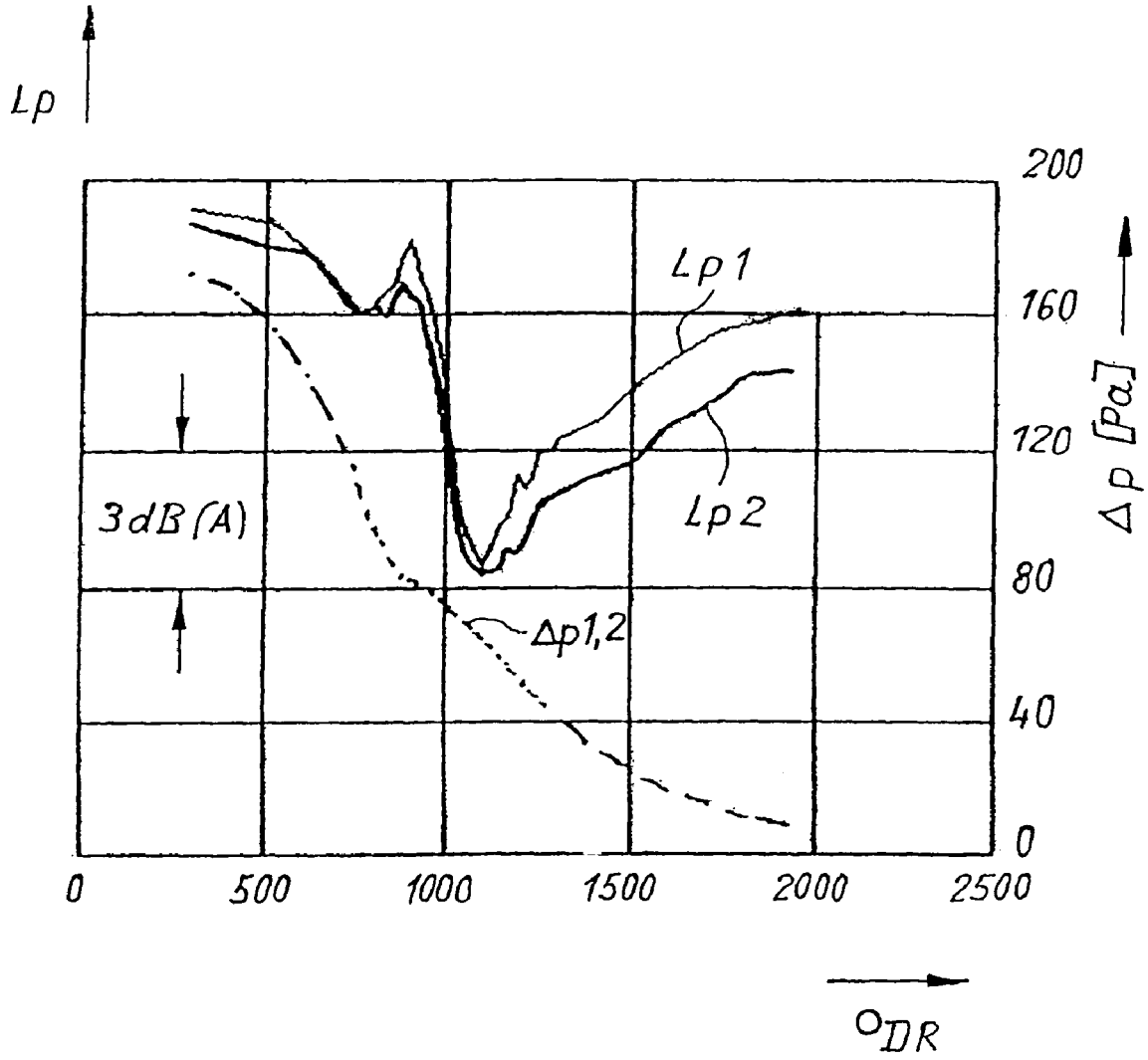
FIG. 12 is a depiction comparing the curves in FIGS. 10 and 11; it is apparent that, with this exemplifying embodiment, a reduction in the acoustic pressure level Lp is obtained in particularly pronounced fashion in the laminar region, but also in the turbulent region.

For comparison, it should be noted that in the case of fan wheel 22 according to FIGS. 1 to 12, outer end 30A to 30E of sickles 28 is located in each case on the same radius vector as inner end 32A to 32E, which yields an axially shorter construction but is less favorable for noise reduction than the version according to FIGS. 13 to 15, as is evident from a comparison of the measurement curves according to FIG. 12 and FIG. 15.

The rear edges of blades 126A to 126E are labeled 136A to 136E and likewise have a more pronounced sickle-shaped curvature than in the version according to FIGS. 1 to 12. Their intersection with struts 18 of housing 12 once again occurs "with a grazing intersection," as described in detail with reference to FIGS. 1 to 12.

It should be noted, in this context, that for the version according to FIGS. 13 to 15, a shape was used for the external housing such that struts 18 extend in mirror-image fashion with respect to FIG. 1. For example, in FIG. 1 strut 18 extends from an outer point that would correspond to approximately 6 o'clock on a clock face to an inner point that corresponds to approximately 8 o'clock. In the version according to FIGS. 13 to 15, this strut would extend from an outer point corresponding to approximately 6 o'clock to an inner point that corresponds to approximately 4 o'clock. This results in the aforementioned "grazing intersection" for the fan wheels of FIGS. 13 and 14.

The outer radial edges of blades 126 are labeled 140A to 140E. Analogously to FIG. 5, these edges 140 are at a small radial distance d from the inner side of fan housing 12. Through the gap thereby formed, a leakage flow flows from the delivery side to the intake side of the fan.

To reduce this air flow, the individual blades 126 are equipped in the region of their radially outer edges 140 with flow elements 142A to 142E that extend in the axial direction between the intake side and delivery side.

The shape of flow elements 142 may be very easily gathered from the depiction of FIG. 14, which very clearly shows, in particular, flow element 142D and a portion of flow element 142C. The contour of flow elements 142 is the same as described in detail with reference to FIG. 6 for flow element 42C, and the same applies to the profile of blades 126, so that for this portion the reader may be referred to the description of FIGS. 1 to 12. In combination with the narrow air gap d (FIG. 5), flow elements 142 present an increased resistance to the leakage flow that proceeds, during operation, around outer rim 140 of blades 126 from the delivery side to the intake side.

As is clearly evident from FIG. 14, the individual blades 126 are twisted, i.e. the location from which a blade 126, so to speak, "grows" out of hub 120 has approximately the shape of a screw-thread segment, and outer edges 140 of blades 126 are likewise shaped in the manner of a screw-thread segment although, as depicted, the pitch is greater in the region of hub 120 than in the region of the radially outer edges 140.

FIG. 15 shows, in comparative fashion, fan characteristic curves for fan wheel 122 without flow elements and for fan wheel 122 with flow elements 142, with the same air gap d (as in the depictions of FIGS. 1 to 12). The pressure rise for a fan wheel without flow elements 142 is labeled $\Delta p3$, and the pressure rise for the same fan wheel 122 with flow elements 142 is labeled $\Delta p4$. It is apparent that a slightly greater pressure rise $\Delta p$ is obtained without flow elements 142.

The acoustic pressure level for a fan wheel without flow elements is labeled Lp3, and the acoustic pressure level for the same fan wheel 122 with elements 142 is labeled Lp4. For this measurement, just as for FIGS. 1 to 12, the measurement microphone was located in front of the intake side of the fan at the axial height of the fan.

Comparing FIG. 15 with FIG. 12, it is evident that the greater sickling of front edges 128, in combination with flow elements 142, has resulted here in a reduction in the acoustic pressure level Lp over the entire measurement range, that reduction being very pronounced especially in the laminar region. For practical use, the noise reduction depends on the region of the relevant fan's characteristic curve in which it is operated, as is common knowledge among those skilled in the art of fans. A physical reason for the noise reduction might be that an air flow can form in the region of the sickle-shaped front edges 128 and flow along an entire front edge 128 from outside to inside, and thus to a region with a low circumferential velocity, flow elements 142 having a positive influence on the beginning of this air flow.

A measurement of the acoustic power LWA for the version according to FIGS. 13 to 15 has revealed that, particularly in the range of the middle-third frequencies from 5 to 20 kHz, it was possible to achieve a reduction in acoustic power as a result of the flow elements. In the region from 160 to 4000 Hz, on the other hand, the acoustic power values differ only slightly, i.e. it is rushing noise in particular that is reduced by flow elements 42 and 142.

Many variants and modifications are, of course, possible within the scope of the present invention.

What is claimed is:

1. An equipment fan, comprising a housing radially surrounding a fan wheel, said housing having an inner side which defines an air conveying conduit in which said fan wheel is arranged, said fan wheel being rotatable about a central axis and including a central hub having an outer periphery on which are mounted fan blades whose radially outer rims are each at a distance (d) from the adjacent inner side of the fan housing, wherein each of said blades is shaped like an airfoil profile of an aircraft, the blades each being implemented in concave and sickle-shaped fashion on their front edge, in such a way that a radially outer end of a sickle is located, with reference to a rotation direction of said fan wheel, farther forward in a circumferential direction than a hub-side end of the sickle, and the blades are furthermore each twisted between said hub-side end and said radially outer end and have a convex rear edge, and along the twisted radial outer edge of each fan blade and adjacently to the inner side of the external housing, a flow element is provided which has an outline analogous to that of the associated fan blade and which is implemented as a flow-pattern obstacle for a compensating flow proceeding around that twisted radial outer edge from the delivery side to the intake side, in order to reduce noise generated during operation by the equipment fan, and wherein the flow elements each have a profile that, adjacent a front edge of a fan blade, increases from that front edge in the manner of the front edge of an airfoil, and tapers adjacent a rear edge in the manner of the rear edge of an airfoil.

2. The fan according to claim 1, wherein said external housing is formed with at least one strut extending transversely to the air conveying conduit, and the rear edge of the blades is implemented convexly, in such a way that, upon rotation of the fan wheel, each rear edge, viewed in plan, intersects that strut at different locations at successive points in time.

3. The fan according to claim 2, wherein the convex rear edge is implemented with grazing intersections.

4. The fan according to claim 1, wherein the concavely sickle-shaped front edge has a region that lags the most, with reference to the rotational motion, which region is located substantially at the transition from the hub to the front edge of the relevant blade

5. The fan according to claim 1, wherein the concavely sickle-shaped front edge encloses, with the region of the hub located in front of the relevant blade, an angle (alpha) that is equal to approximately 90° or less.

6. The fan according to claim 1, wherein the blade is twisted in such a way that it has a thread pitch which is greater at the hub than near radially outer edges of the blade.

7. The fan according to claim 1, wherein the fan blades each have, viewed in a sagittal section, a profile that corresponds approximately to an airfoil profile.

8. The fan according to claim 1, wherein the respective flow elements extend at least locally on both a delivery side of the fan and an intake side of the fan, along respective radially outer rims of the fan blades.

9. An equipment fan, comprising a housing radially surrounding a fan wheel, said housing having an inner side which defines an air conveying conduit in which said fan wheel is arranged, said fan wheel being rotatable about a central axis and including a central hub having an outer periphery on which are mounted fan blades whose radially outer rims are each at a distance (d) from the adjacent inner side of the fan housing, wherein each of said blades is shaped like an airfoil profile of an aircraft, the blades each being implemented in concave and sickle-shaped fashion on their front edge, in such a way that a radially outer end of a sickle is located, with reference to a rotation direction of said fan wheel, farther forward in a circumferential direction than a hub-side end of the sickle, and the blades are furthermore each twisted between said hub-side end and said radially outer end and have a convex rear edge, and along the twisted radial outer edge of each fan blade and adjacently to the inner side of the external housing, a flow element is provided which has an outline analogous to that of the associated fan blade and which is implemented as a flow-pattern obstacle for a compensating flow proceeding around that twisted radial outer edge from the delivery side to the intake side, in order to reduce noise generated during operation by the equipment fan, and wherein the fan blades, viewed in a radial section, are shaped convexly toward the intake side, and transition at least over a part of their extension, in their radially outer region, with a radius of curvature, into a portion of the associated flow element projecting toward the intake side.

10. The fan according to claim 9, wherein said external housing is formed with at least one strut extending transversely to the air conveying conduit, and the rear edge of the blades is implemented convexly, in such a way that, upon rotation of the fan wheel, each rear edge, viewed in plan, intersects that strut at different locations at successive points in time.

11. The fan according to claim 10, wherein the convex rear edge is implemented with grazing intersections.

12. The fan according to claim 9, wherein the concavely sickle-shaped front edge has a region that lags the most, with reference to the rotational motion, which region is located substantially at the transition from the hub to the front edge of the relevant blade.

13. The fan according to claim 9, wherein the concavely sickle-shaped front edge encloses, with the region of the hub located in front of the relevant blade, an angle (alpha) that is equal to approximately 90° or less.

14. The fan according to claim 9, wherein the blade is twisted in such a way that it has a thread pitch which is greater at the hub than near radially outer edges of the blade.

15. The fan according to claim 9, wherein the fan blades each have, viewed in a sagittal section, a profile that corresponds approximately to an airfoil profile.

16. The fan according to claim 9, wherein the respective flow elements extend at least locally on both a delivery side of the fan and an intake side of the fan, along respective radially outer rims of the fan blades.

17. The fan according to claim 9, wherein the flow elements each have a profile that, adjacent a front edge of a fan blade, increases from that front edge in the manner of the front edge of an airfoil, and tapers adjacent a rear edge in the manner of the rear edge of an airfoil.

18. An equipment fan, comprising a housing radially surrounding a fan wheel, said housing having an inner side which defines an air conveying conduit in which said fan wheel is arranged, said fan wheel being rotatable about a central axis and including a central hub having an outer periphery on which are mounted fan blades whose radially outer rims are each at a distance (d) from the adjacent inner side of the fan housing, wherein each of said blades is shaped like an airfoil profile of an aircraft, the blades each being implemented in concave and sickle-shaped fashion on their front edge, in such a way that a radially outer end of a sickle is located, with reference to a rotation direction of said fan wheel, farther forward in a circumferential direction than a hub-side end of the sickle, and the blades are furthermore each twisted between said hub-side end and said radially outer end and have a convex rear edge, and along the twisted radial outer edge of each fan blade and adjacently to the inner side of the external housing, a flow element is provided which has an outline analogous to that of the associated fan blade and which is implemented as a flow-pattern obstacle for a compensating flow proceeding around that twisted radial outer edge from the delivery side to the intake side, in order to reduce noise generated during operation by the equipment fan, and wherein the fan blades, viewed in a radial section, are shaped concavely toward an air delivery side of the fan, and transition at least over a part of their extension, with their radially outer rim, with a radius of curvature, into a portion of the associated flow element projecting toward the delivery side.

19. The fan according to claim 18, wherein said external housing is formed with at least one strut extending transversely to the air conveying conduit, and the rear edge of the blades is implemented convexly, in such a way that, upon rotation of the fan wheel, each rear edge, viewed in plan, intersects that strut at different locations at successive points in time.

20. The fan according to claim 19, wherein the convex rear edge is implemented with grazing intersections.

21. The fan according to claim 18, wherein the concavely sickle-shaped front edge has a region that lags the most, with reference to the rotational motion, which region is located substantially at the transition from the hub to the front edge of the relevant blade.

22. The fan according to claim 18, wherein the concavely sickle-shaped front edge encloses, with the region of the hub located in front of the relevant blade, an angle (alpha) that is equal to approximately 90° or less.

23. The fan according to claim 18, wherein the blade is twisted in such a way that it has a thread pitch which is greater at the hub than near radially outer edges of the blade.

24. The fan according to claim 18, wherein the fan blades each have, viewed in a sagittal section, a profile that corresponds approximately to an airfoil profile.

25. The fan according to claim 18, wherein the respective flow elements extend at least locally on both a delivery side of the fan and an intake side of the fan, along respective radially outer rims of the fan blades.

26. The fan according to claim 18, wherein the flow elements each have a profile that, adjacent a front edge of a fan blade, increases from that front edge in the manner of the front edge of an airfoil, and tapers adjacent a rear edge in the manner of the rear edge of an airfoil.

27. The fan according to claim 18, wherein the fan blades, viewed in a radial section, are implemented convexly toward the intake side, and transition at least over a portion of their extension, in their radially outer region, with a radius of curvature, into a portion of the associated flow element projecting toward the intake side.

28. A fan comprising:

an air conveying conduit and a fan wheel arranged therein, which wheel is rotatable about a central axis and is formed with a central hub having an outer periphery on which are mounted fan blades that extend with their radially outer rims as far as a surface that is substantially coaxial with the central axis and delimits the air conveying conduit externally, which blades each have a profile that is shaped like the airfoil profile of an aircraft, there being provided, along the radial outer edge of the fan blades, a respective flow element that is implemented as a flow-pattern obstacle for a compensating flow proceeding around that radial outer edge from the delivery side to the intake side, which flow element is likewise cross-sectionally shaped substantially like an airfoil profile, and has, adjacent its front edge and the rear edge of a blade substantially the same outline as the adjacent part of the associated blade, and in a middle region between the front and back edge is wider, by an approximately constant amount, than the adjacent part of the blade and wherein the fan blades, viewed in a radial section, are implemented convexly toward the intake side, and transition at least over a portion of their extension, in their radially outer region, with a radius of curvature, into a portion of the associated flow element projecting toward the intake side.

29. The fan according to claim 28, wherein, in a transition region between the front edge and middle region, a ratio of the axial extension of the flow element to the axial extension (D) of the adjacent blade increases in the direction away from the front edge.

30. The fan according to claim 28, wherein, in a transition region between the rear edge and middle region, a ratio of the axial extension of the flow element to the axial extension (D) of the adjacent blade increases in the direction away from the rear edge.

31. The fan according to claim 28, wherein the flow elements extend, at least locally, on both sides, i.e. on the delivery and intake sides, along the radially outer rim of the fan blades.

32. The fan according to claim 28, wherein each of said blades has a front edge which is concave and sickle-shaped, so that, defining forward with respect to a rotation direction of the fan, a radially outer end of a sickle projects further forward than does a hub-adjacent end of the sickle.

33. The fan according to claim 28, wherein the blades are each twisted in such a way that their pitch at the hub is greater than the pitch in the region of the radially outer edge.

34. The fan according to claim 28, wherein the blades are implemented in the region of the rear edge convexly and with grazing intersections.

35. The fan according to claim 28, which comprises an external housing from which there extends away at least one strut proceeding transversely to the air conveying conduit, and the rear edge of the blades is implemented convexly in such a way that, upon rotation of the fan wheel, that rear edge, viewed in plan, intersects that strut at different locations at successive points in time.

36. A fan comprising:

an air conveying conduit and a fan wheel arranged therein, which wheel is rotatable about a central axis and is formed with a central hub having an outer periphery on which are mounted fan blades that extend with their radially outer rims as far as a surface that is substantially coaxial with the central axis and delimits the air conveying conduit externally, which blades each have a profile that is shaped like the airfoil profile of an aircraft, there being provided, along the radial outer edge of the fan blades, a respective flow element that is implemented as a flow-pattern obstacle for a compensating flow proceeding around that radial outer edge from the delivery side to the intake side, which flow element is likewise cross-sectionally shaped substantially like an airfoil profile, and has, adjacent its front edge and the rear edge of a blade substantially the same outline as the adjacent part of the associated blade, and in a middle region between the front and back edge is wider, by an approximately constant amount, than the adjacent part of the blade and wherein the fan blades, viewed in a radial section, are curved concavely toward a delivery side of the fan, and transition at least over a portion of their extension, with their radially outer rim, with a radius of curvature, into a portion of the associated flow element projecting toward the delivery side of the fan.

37. The fan according to claim 36, wherein, in a transition region between the front edge and middle region, a ratio of the axial extension of the flow element to the axial extension (D) of the adjacent blade increases in the direction away from the front edge.

38. The fan according to claim 36, wherein, in a transition region between the rear edge and middle region, a ratio of the axial extension of the flow element to the axial extension (D) of the adjacent blade increases in the direction away from the rear edge.

39. The fan according to claim 36, wherein the flow elements extend, at least locally, on both sides, i.e. on the delivery and intake sides, along the radially outer rim of the fan blades.

40. The fan according to claim 36, wherein each of said blades has a front edge which is concave and sickle-shaped, so that, defining forward with respect to a rotation direction of the fan, a radially outer end of a sickle projects further forward than does a hub-adjacent end of the sickle.

41. The fan according to claim 36, wherein the blades are each twisted in such a way that their pitch at the hub is greater than the pitch in the region of the radially outer edge.

42. The fan according to claim 36, wherein the blades are implemented in the region of the rear edge convexly and with grazing intersections.

43. The fan according to claim 36, which comprises an external housing from which there extends away at least one strut proceeding transversely to the air conveying conduit, and the rear edge of the blades is implemented convexly in such a way that, upon rotation of the fan wheel, that rear edge, viewed in plan, intersects that strut at different locations at successive points in time.

44. The fan according to claim 36, wherein the fan blades, viewed in a radial section, are implemented convexly toward the intake side, and transition at least over a portion of their extension, in their radially outer region, with a radius of curvature, into a portion of the associated flow element projecting toward the intake side.

45. A fan comprising:

an air conveying conduit and a fan wheel arranged therein, which wheel is rotatable about a central axis and is formed with a central hub having an outer periphery on which are mounted fan blades that extend with their radially outer rims as far as a surface that is substantially coaxial with the central axis and delimits the air conveying conduit externally, which blades each have a profile that is shaped like the airfoil profile of an aircraft, there being provided, along the radial outer edge of the fan blades, a respective flow element that is implemented as a flow-pattern obstacle for a compensating flow proceeding around that radial outer edge from the delivery side to the intake side, which flow element is likewise cross-sectionally shaped substantially like an airfoil profile, and has, adjacent its front edge and the rear edge of a blade substantially the same outline as the adjacent part of the associated blade, and in a middle region between the front and back edge is wider, by an approximately constant amount, than the adjacent part of the blade, wherein said fan is implemented as a diagonal fan, and wherein the flow elements are provided only on the intake side of the blades.

46. The fan according to claim 45, wherein, in a transition region between the front edge and middle region, a ratio of the axial extension of the flow element to the axial extension (D) of the adjacent blade increases in the direction away from the front edge.

47. The fan according to claim 45, wherein, in a transition region between the rear edge and middle region, a ratio of the axial extension of the flow element to the axial extension (D) of the adjacent blade increases in the direction away from the rear edge.

48. The fan according to claim 45, wherein the flow elements extend, at least locally, on both sides, i.e. on the delivery and intake sides, along the radially outer rim of the fan blades.

49. The fan according to claim 45, wherein each of said blades has a front edge which is concave and sickle-shaped, so that, defining forward with respect to a rotation direction of the fan, a radially outer end of a sickle projects further forward than does a hub-adjacent end of the sickle

50. The fan according to claim 45, wherein the blades are each twisted in such a way that their pitch at the hub is greater than the pitch in the region of the radially outer edge.

51. The fan according to claim 45, wherein the blades are implemented in the region of the rear edge convexly and with grazing intersections.

52. The fan according to claim 45, which comprises an external housing from which there extends away at least one strut proceeding transversely to the air conveying conduit, and the rear edge of the blades is implemented convexly in such a way that, upon rotation of the fan wheel, that rear edge, viewed in plan, intersects that strut at different locations at successive points in time.

53. The fan according to claim 45, wherein the fan blades, viewed in a radial section, are implemented convexly toward the intake side, and transition at least over a portion of their extension, in their radially outer region, with a radius of curvature, into a portion of the associated flow element projecting toward the intake side.

54. The fan according to claim 45, wherein the fan blades, viewed in a radial section, are curved concavely toward a delivery side of the fan, and transition at least over a portion of their extension, with their radially outer rim, with a radius of curvature, into a portion of the associated flow element projecting toward the delivery side of the fan.

* * * * *